US011930868B2

(12) United States Patent
Zlotkin

(10) Patent No.: US 11,930,868 B2
(45) Date of Patent: Mar. 19, 2024

(54) WEARABLE BLANKET USABLE AS A BLANKET, TOWEL, WRAP, AND WORN FASHIONABLY AS A SKIRT

(71) Applicant: Tara A. Zlotkin, Berwyn, PA (US)

(72) Inventor: Tara A. Zlotkin, Berwyn, PA (US)

( * ) Notice: Subject to any disclaimer, the term of this patent is extended or adjusted under 35 U.S.C. 154(b) by 76 days.

(21) Appl. No.: 17/951,764

(22) Filed: Sep. 23, 2022

(65) Prior Publication Data

US 2023/0097271 A1 Mar. 30, 2023

Related U.S. Application Data

(60) Provisional application No. 63/250,346, filed on Sep. 30, 2021.

(51) Int. Cl.

| | |
|---|---|
| ***A47G 9/04*** | (2006.01) |
| ***A41D 1/14*** | (2006.01) |
| ***A41D 15/04*** | (2006.01) |
| ***A47G 9/02*** | (2006.01) |
| ***A47K 10/02*** | (2006.01) |

(52) U.S. Cl.

CPC ..... *A41D 15/04* (2013.01); *A41D 1/14* (2013.01); *A47G 9/0223* (2013.01); *A47G 9/04* (2013.01); *A47K 10/02* (2013.01)

(58) Field of Classification Search

CPC ..... A41D 15/04; A41D 1/14; A47G 9/0223; A47G 9/04; A47G 9/064; A47G 9/066; A47K 10/02

See application file for complete search history.

(56) References Cited

U.S. PATENT DOCUMENTS

| | | | | | |
|---|---|---|---|---|---|
| 608,351 | A * | 8/1898 | Terramorse | A41D 15/04 | 5/413 R |
| 782,819 | A * | 2/1905 | Bikle | A47G 9/08 | 2/114 |
| 1,102,408 | A * | 7/1914 | Hubner | A41D 1/02 | 5/413 R |
| 1,252,628 | A * | 1/1918 | Terry | A41D 15/04 | 2/89 |
| 1,519,741 | A * | 12/1924 | Schickerling | B60N 2/6009 | 296/81 |
| 2,644,948 | A * | 7/1953 | Gutmann | A47G 9/086 | 5/413 R |
| 2,980,169 | A * | 4/1961 | Campbell | B60N 2/6054 | 296/81 |

(Continued)

*Primary Examiner* — Robert H Muromoto, Jr.
(74) *Attorney, Agent, or Firm* — H. Brock Kolls

(57) ABSTRACT

A wearable blanket usable as a blanket, a towel, a wrap, and worn fashionably as a skirt. The front and back fabric panels are trapezoids in shape. Pockets are formed by pocket bags that are positioned between the front and back fabric layers and aligned with seams in the front panel allowing a person to insert their hands into the pocket bags when wearing the wearable blanket. A stretchable belt tab is stretchable, has a hook-and-loop surface portion, and is fastened along an edge of the wearable blanket. A belt receiver has a hook-and-loop portion and is fastened to the front fabric panel. The belt receiver fastens with the stretchable belt tab in a stretched orientation. The recoil force of the stretchable belt tab pulls the top edge of the wearable blanket snuggly around the waist or torso of the person wearing the wearable blanket.

20 Claims, 13 Drawing Sheets

(56) References Cited

U.S. PATENT DOCUMENTS 3,013,274 A * 12/1961 Dike ..... A41D 7/008 2/92
3,176,315 A * 4/1965 Freund ..... A41D 15/04 5/419
3,381,306 A * 5/1968 Innes ..... A47G 9/086 5/413 R
3,443,066 A * 5/1969 Weibel ..... H05B 3/342 5/413 R
3,958,274 A * 5/1976 Klauber ..... A41D 15/04 5/420
4,180,867 A * 1/1980 Ridgeway, Jr. ..... A45F 4/02 135/96
4,484,362 A * 11/1984 Asher ..... A45F 3/22 5/413 R
4,514,870 A * 5/1985 Tyler, Jr. ..... B60N 2/6009 5/482
4,567,611 A * 2/1986 Kendrick ..... A41D 1/215 2/104
4,573,227 A * 3/1986 Prandina ..... A47G 9/0207 5/486
4,656,670 A * 4/1987 Schluter ..... B60N 2/60 2/92
4,703,521 A * 11/1987 Asher ..... A41D 15/04 2/69.5
4,759,082 A * 7/1988 Mulligan ..... A41B 13/06 2/69.5
4,789,247 A * 12/1988 Schnoor ..... A45F 4/02 493/267
4,932,077 A * 6/1990 Dobbs ..... A61G 5/1054 2/69.5
5,257,427 A * 11/1993 Hinshaw ..... A47G 9/086 5/613
5,283,909 A * 2/1994 Hill ..... A47G 9/066 2/22
5,443,488 A * 8/1995 Namenye ..... A61F 7/0097 607/104
5,463,783 A * 11/1995 Pope ..... A45F 4/02 2/88
5,697,102 A * 12/1997 Benjamin ..... A41D 7/008 2/84
5,722,127 A * 3/1998 Coates ..... A61F 13/622 24/304
5,814,037 A * 9/1998 Coates ..... A61F 13/49004 604/397
5,887,301 A * 3/1999 Anderson ..... A45F 4/02 5/482
6,014,772 A * 1/2000 Connelly ..... A41D 15/04 2/102
6,223,367 B1 * 5/2001 French ..... A47G 9/0207 5/419
6,275,993 B1 * 8/2001 McCarley ..... A41D 15/04 2/84
6,338,173 B1 * 1/2002 Ramsey ..... A47G 9/086 5/413 R
6,393,637 B1 * 5/2002 Hoffman ..... A41D 15/04 5/413 R
6,484,333 B1 * 11/2002 Hill ..... B60N 2/6009 2/49.4
6,643,870 B2 * 11/2003 Bertrand ..... A47G 9/066 5/636
6,859,940 B1 * 3/2005 Sholander ..... A41D 7/008 2/46
6,966,069 B2 * 11/2005 Booth ..... A47G 9/066 2/48
7,246,392 B2 * 7/2007 Schmid ..... A41B 13/06 5/655
7,832,032 B2 * 11/2010 Haislip ..... A41D 15/04 5/413 R
8,424,113 B2 * 4/2013 Sprole ..... A47G 9/064 2/69.5
8,464,374 B1 * 6/2013 Thayer ..... A45F 4/12 5/413 R
8,640,262 B2 * 2/2014 Rossi ..... A41D 7/008 2/84
D727,664 S * 4/2015 George ..... D6/608
9,095,240 B2 * 8/2015 Bowen ..... A47K 10/02
D744,263 S * 12/2015 Quinones ..... D2/719
D745,791 S * 12/2015 Corley ..... D6/603
9,204,673 B1 * 12/2015 Alperin ..... A41B 13/005
9,439,463 B1 * 9/2016 Spears ..... A41D 3/08
D771,978 S * 11/2016 McCullough, Jr. ..... D6/603
9,532,618 B2 * 1/2017 Garabedian ..... A41D 27/20
D791,511 S * 7/2017 Walker ..... D6/603
D792,679 S * 7/2017 Gamble ..... D2/826
9,700,086 B2 * 7/2017 Gamble ..... A41D 15/00
9,756,882 B2 * 9/2017 Townsend ..... A41D 13/0012
9,775,387 B2 * 10/2017 Parr ..... A41D 3/00
9,814,276 B2 * 11/2017 James ..... A41D 23/00
10,117,471 B2 * 11/2018 Nam ..... A41D 27/24
10,306,938 B2 * 6/2019 Kingsmore ..... A47G 9/066
10,342,367 B2 * 7/2019 Dimotsantos ..... A47G 9/10
10,681,997 B1 * 6/2020 Rigas ..... A47C 31/11
10,722,056 B2 * 7/2020 Thomas ..... A47G 9/066
D901,939 S * 11/2020 Liu ..... D6/596
10,918,138 B2 * 2/2021 Lloyd ..... A41B 13/06
10,966,553 B1 * 4/2021 Wilson-Brown .... A47G 9/1045
11,337,468 B2 * 5/2022 Reynolds ..... A41D 3/04
11,528,949 B2 * 12/2022 Sherts ..... A47G 9/066
D984,091 S * 4/2023 Chen ..... D2/823
2007/0061965 A1 * 3/2007 Crawford ..... A47G 9/086 5/413 R
2008/0028518 A1 * 2/2008 Miotke ..... A47G 9/086 5/413 R
2008/0066229 A1 * 3/2008 Auer ..... A41D 3/08 2/84
2008/0078027 A1 * 4/2008 Smith ..... A41D 15/04 5/413 R
2010/0071110 A1 * 3/2010 Stevens ..... A41D 27/20 2/69
2010/0139001 A1 * 6/2010 Mangano ..... A47G 9/1045 297/229
2010/0199402 A1 * 8/2010 Curtis ..... A47G 9/064 2/69
2010/0256716 A1 * 10/2010 Haislip ..... A47G 9/086 5/413 R
2011/0191932 A1 * 8/2011 Earnest ..... A41B 13/06 2/69
2012/0151654 A1 * 6/2012 Chopak ..... A44B 19/382 5/413 R
2016/0135518 A1 * 5/2016 Scott ..... A47K 10/02 2/69
2020/0107591 A1 * 4/2020 King, Jr. ..... A41D 13/0012
2021/0274952 A1 * 9/2021 Coe ..... A61F 5/3776
2023/0077610 A1 * 3/2023 Williams ..... A47G 9/083 2/69.5

* cited by examiner

Fig. 7
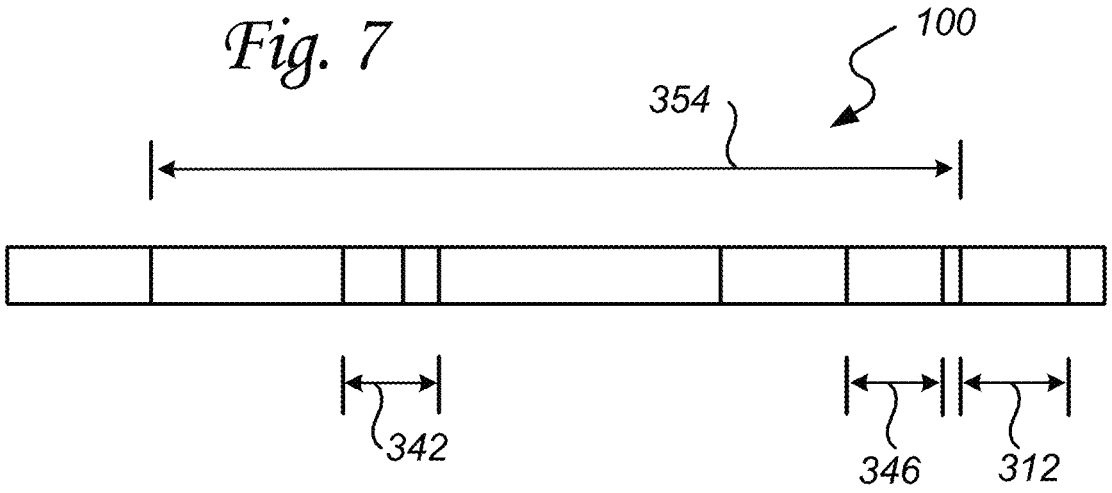
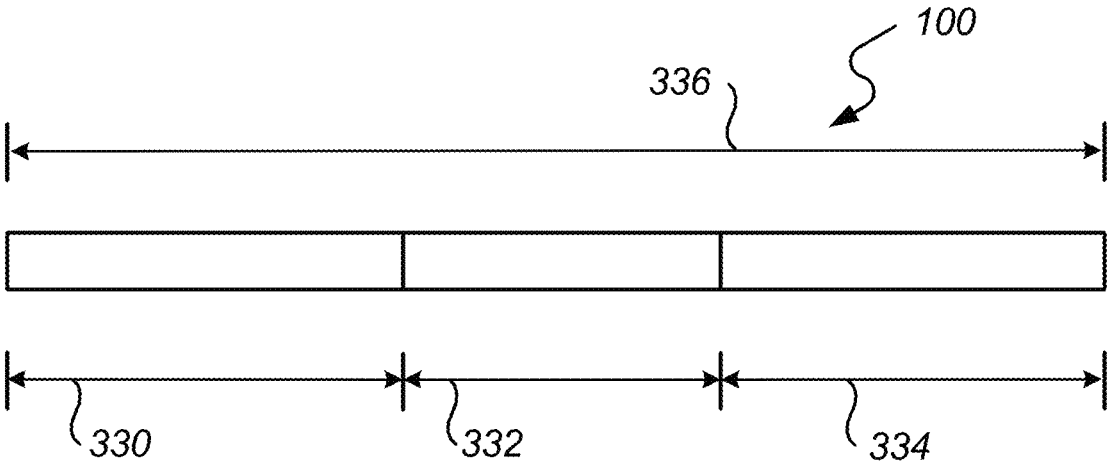
Fig. 8

WEARABLE BLANKET USABLE AS A BLANKET, TOWEL, WRAP, AND WORN FASHIONABLY AS A SKIRT

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that claims the benefit of a U.S. provisional application, Ser. No. 63/250,346, inventor Tara A. Zlotkin, entitled "WEARABLE BLANKET THAT CAN BE WORN LIKE A BLANKET, TOWEL, WRAP, OR SKIRT", filed Sep. 30, 2021.

TECHNICAL FIELD OF THE INVENTION

This invention relates to a wearable blanket and particularly to a wearable blanket that can be used as a blanket, towel, or wrap, and also worn fashionably as a skirt.

BACKGROUND OF THE INVENTION

Before our invention, it was common to see people wrapped in blankets at a sporting event however, once wrapped they are unable to freely stand and move around without the concern that the blanket would come unwrapped, leaking cold air in poorly fitted areas, or just falling down. It was hard to be the kind of fan that stands to cheer their favorite team and be wrapped in a blanket.

Furthermore, it was worrisome to consider walking wrapped in a blanket and/or trying to carry items in your hands or arms for fear the blanket was going to loosen, slip or fall, cause you to trip, or otherwise become a burdensome hassle requiring the use of your hands and arms as well as requiring constant readjustment.

Other shortcomings include the fact that blankets weren't considered clothing and as such were not designed to fit the contours of the human body, be functional, and look good as an article of clothing. In this regard, not only were blankets limited to being, well blankets, but blankets were not considered wearable and transformable for a variety of purposes including use as a towel, wrap, skirt, or blanket.

The present invention addresses these and other shortcomings by providing a wearable blanket that can be worn like a blanket, towel, wrap, or skirt. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a wearable blanket usable as a blanket, a towel, a wrap, and worn fashionably as a skirt a back fabric panel that is trapezoid in shape, and a front fabric panel that is trapezoid in shape, The front fabric panel comprises a first seam and a second seam, the front fabric panel is overlaid with the back fabric panel and fastened together along perimeter forming a first side edge, and a second side edge, a top edge, and a bottom edge that is longer than the top edge.

The wearable blanket further comprises one or more pocket bags. Each pocket bag has an open end and a closed end. The pocket bag is positioned between the back fabric layer and the front fabric layer. The open end of the first one of the pocket bag is aligned with the first seam and the closed end points to the first side. The open end of the second one of the pocket bag is aligned with the second seam and the closed end points to the second side. The pockets formed by the pocket bags allow a person to insert their hands into the pocket bags when wearing the wearable blanket.

The wearable blanket further comprises a stretchable belt tab that is positioned and secured along the second edge proximate to the top edge. The stretchable belt tab is stretchable. A first hook-and-loop surface can be fastened to at least a portion of the stretchable belt tab. A belt receiver is fastened to the front fabric panel proximate to the top edge. At least a portion of the belt receiver has a second hook-and-loop surface for fastening, in a removable manner, with the first hook-and-loop surface when the stretchable belt tab is in a stretched orientation securing the wearable blanket around the waist of the person such that the recoil force of the stretchable belt tab pulls the top edge snuggly around the waist of the person preventing the wearable blanket from slipping or rotating when worn by the person.

Additional shortcomings of the prior art are overcome and additional advantages are provided through the provision of a method of using a wearable blanket that can be used as a blanket, a towel, a wrap, and worn fashionably as a skirt. The method comprises the steps of positioning a wearable blanket along the posterior of a person. The wearable blanket comprises a back fabric panel that is trapezoid in shape and a front fabric panel that is trapezoid in shade. The front fabric panel comprises a first seam and a second seam. The front fabric panel is overlaid with the back fabric panel and fastened together along the perimeter forming a first side edge, a second side edge, a top edge, and a bottom edge that is longer than the top edge.

The wearable blanket further comprises one or more pocket bag. Each of the pocket bag has an open end and a closed end. The pocket bag is positioned between the back fabric layer and the front fabric layer. The open end of the first one of the pocket bag is aligned with the first seam and the closed end points to the first side and can be tacked or otherwise fastened into position. The open end of the second one of the pocket bag is aligned with the second seam and the closed end points to the second side and can be tacked or otherwise fastened into position. The pockets, formed by the pocket bags allow the person to insert their hands into the pocket bag when wearing the wearable blanket.

The wearable blanket further comprises a stretchable belt tab that is positioned and secured along the second edge proximate to the top edge. The stretchable belt tab is stretchable. A first hook-and-loop surface can be fastened to at least a portion of the stretchable belt tab. A belt receiver is fastened to the front fabric panel proximate to the top edge. At least a portion of the belt receiver has a second hook-and-loop surface for fastening, in a removable manner, with the first hook-and-loop surface when the stretchable belt tab is in a stretched orientation securing the wearable blanket around the waist of the person such that the recoil force of the stretchable belt tab pulls the top edge snuggly around the waist of the person preventing the wearable blanket from slipping or rotating when worn by the person.

The method continues by, wrapping the wearable blanket around the person, overlapping the first side and the second side proximate to the stomach of the person. Stretching the stretchable belt tab to snuggly fit the wearable blanket around the waist of the person. And fastening the stretchable belt tab to the belt receiver, in a removable manner, holding the wearable blanket around the person.

Additional shortcomings of the prior art are overcome and additional advantages are provided through the provision of a method of using a wearable blanket that can be used as a blanket, a towel, a wrap, and worn fashionably as a skirt. The method comprises the steps of folding a hook-and-loop cover over a stretchable belt tab, to secure the loose end of the stretchable belt tab in a removable manner, when the wearable blanket doesn't need to be secured around a person. The hook-and-loop cover is positioned and secured along a top edge proximate to the stretchable belt tab. Folding a flap pocket over a belt receiver The flap pocket comprises a flap pocket opening having a pocket fastener. The flap pocket is positioned and secured along a top edge proximate to the belt receiver. The flap pocket by way of the pocket opening is accessible to the person for storing items.

The wearable blanket comprises the hook-and-loop cover, the flap pocket, a back fabric panel that is trapezoid in shape, and a front fabric panel that is trapezoid in shape. The front fabric panel comprises a first seam and a second seam. The front fabric panel is overlaid with the back fabric panel and fastened together along the perimeter forming a first side edge, a second side edge, the top edge, and a bottom edge that is longer than the top edge.

The wearable blanket further comprises one or more pocket bag. Each of the pocket bag has an open end and a closed end. The pocket bag is positioned between the back fabric layer and the front fabric layer. The open end of the first one of the pocket bag is aligned with the first seam and the closed end points to the first side and can be tacked or otherwise fastened into position. The open end of the second one of the pocket bag is aligned with the second seam and the closed end points to the second side and can be tacked or otherwise fastened into position, The pockets formed by the pocket bags allow the person to insert their hands into the pocket bag when wearing the wearable blanket.

The wearable blanket further comprises a stretchable belt tab that is positioned and secured along the second edge proximate to the top edge. The stretchable belt tab is stretchable. A hook-and-loop surface is fastened to at least a portion of the stretchable belt tab. A belt receiver is fastened to the front fabric panel proximate to the top edge. At least a portion of the belt receiver has a hook-and-loop surface.

The method continues by wrapping the wearable blanket around the person wherein the stretchable belt tab and the belt receiver are covered and remain unconnected.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 7 illustrates one example of a top side view of a wearable blanket;

FIG. 8 illustrates one example of a bottom side view of a wearable blanket;

The detailed description explains the preferred embodiments of the invention, together with advantages and features, by way of example with reference to the drawings.

DETAILED DESCRIPTION OF THE INVENTION

In an exemplary embodiment, the wearable blanket 100 can be wrapped securely and snuggly around the waist or torso of person 202. Alternatively, the wearable blanket 100 can be laid flat across one or more persons 202 and/or used as a towel. In general, the wearable blanket 100 of the present invention can be used like a blanket, towel, wrap, and skirt. For disclosure purposes, a blanket is typically laid flat across one or more person's 202. A towel is used to dry off such as after a swim, shower, or other events. A wrap is generally loosely worn over the shoulders or legs often in cool environments such as restaurants, movie theaters, or other environments. And, a skirt is worn as a garment of clothing.

An advantage, in the present invention, is that the wearable blanket 100 is fashionably and functionally designed to fit the contours of the human body particularly the waist of the human body. As such the wearable blanket 100 not only looks good as a garment of clothing when worn but functions by keeping the person 202 warm. In this regard, when worn enabling person 202 to sit, stand, move around, and walk without undue leakage of coldness reaching person 202, or worry that the wearable blanket 100 will move out of position, required readjustment, or become a trip hazard.

Figure 1:
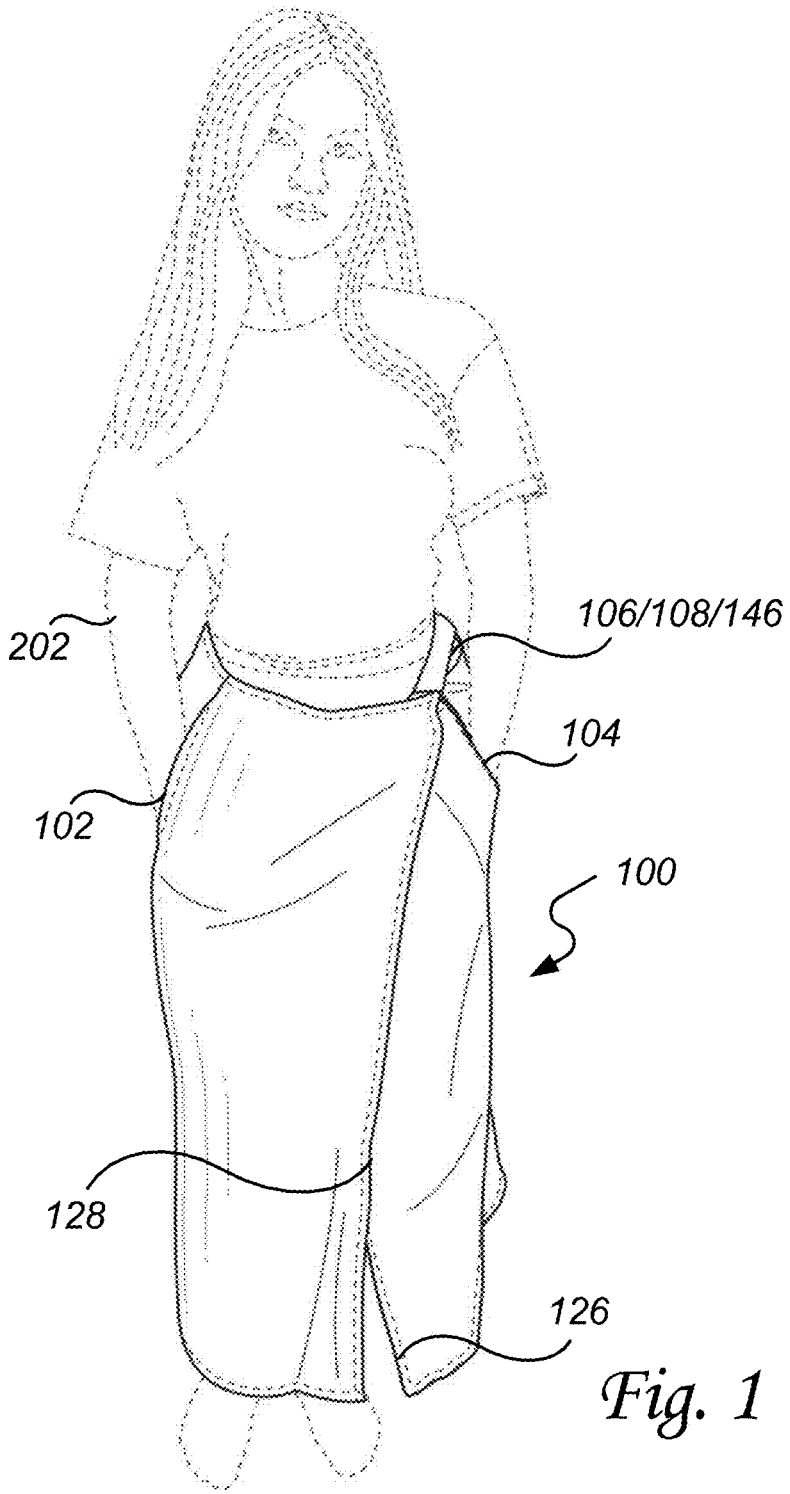
FIG. 1 illustrates one example of a wearable blanket worn by a person standing.

Turning now to the drawings in greater detail, it will be seen that in FIG. 1 there is illustrated one example of a wearable blanket 100 worn by a person 202 standing like a skirt or if desired higher around the torso of person 202.

In an exemplary embodiment, the wearable blanket 100 can be positioned along the posterior of person 202. The wearable blanket 100 can be wrapped around person 202 by overlapping the first side 126 and the second side 128 proximate to the stomach of person 202. The wearable blanket 100 can also be secured higher around the torso of person 202. Once snuggly secured with the stretchable belt tab 116 and belt receiver 118, the wearable blanket 100 remains in place not slipping or rotating out of position. Pockets 102 and 104 can be positioned so that person 202 can insert their hands, as well as, use pockets 102/104 to store items.

In an exemplary embodiment, a flap pocket 106 comprises a flap pocket opening 108 that has at least one pocket fastener 146 such as a button, hook-and-loop, zipper, or other types of fasteners. The flap pocket 106 can be secured along the top edge 124 and configured to fold down to cover the belt receiver 118. By way of pocket opening 108 the flap pocket 106 can be accessible to person 202 for storing items. In the present invention, hook-and-loop can be VELCRO, or other types and kinds of hook-and-loop as may be required and/or desired in a particular embodiment.

Figure 2:
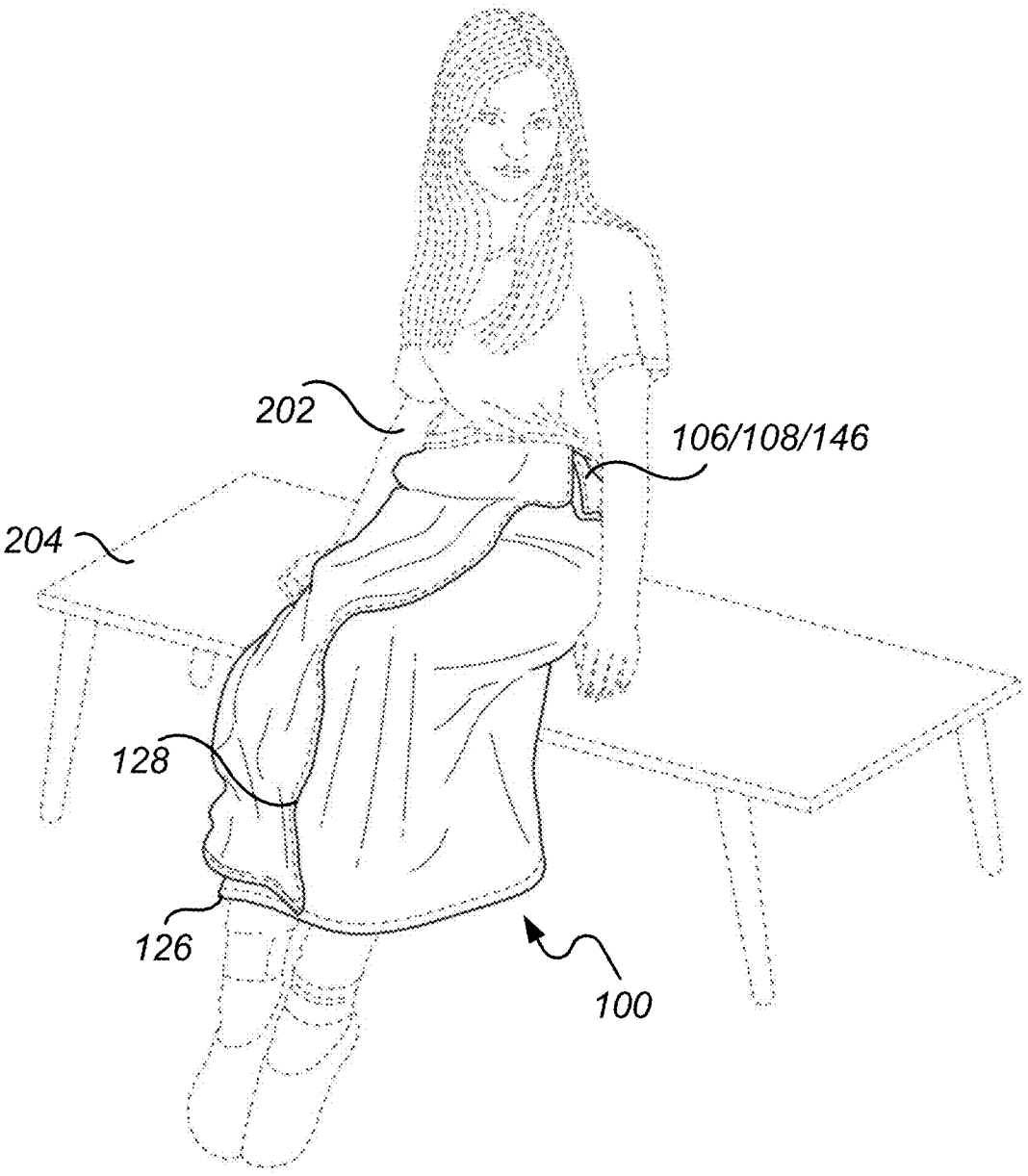
FIG. 2 illustrates one example of a wearable blanket worn by a person seated.

Referring to FIG. 2, there is illustrated one example of a wearable blanket 100 worn by a person 202 seated. An advantage, in the present invention, is that once the wearable blanket 100 is wrapped and secured around the waist or torso of person 202, they can transition between standing (as in FIG. 1), walking, sitting (as in FIG. 2), or engaging in other activities and the wearable blanket 100 does not slip or rotate around the person 202. This is particularly useful when the weather is cold and the person 202 is outdoors such as at a sporting event, a poolside event, or other types and kinds of events. In this regard, the wearable blanket 100 keeps the person 1202 warm as they stand, sit, or otherwise change positions.

Figure 3:
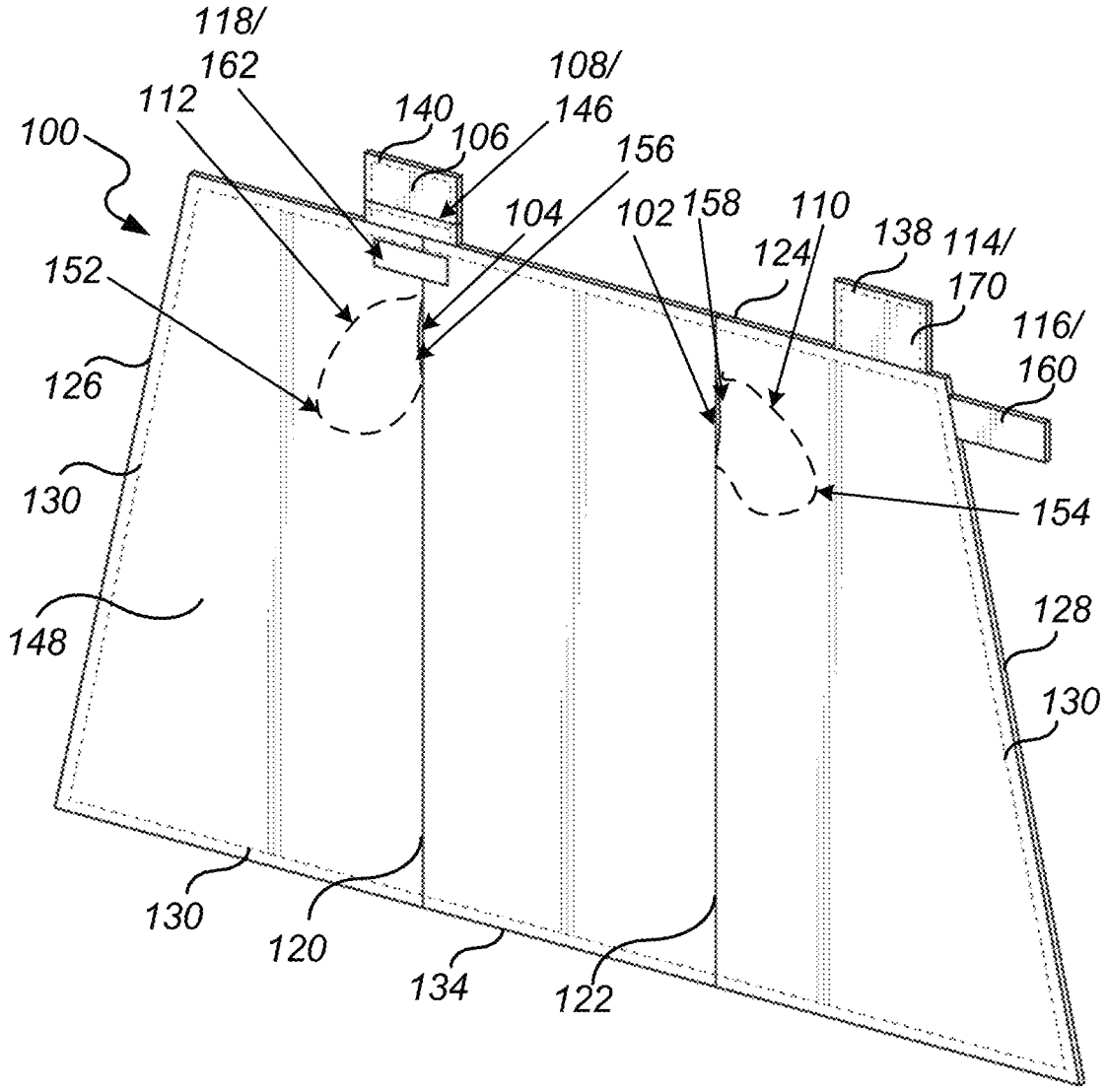
FIG. 3 illustrates one example of a top right front perspective view of a wearable blanket.

Referring to FIG. 3, there is illustrated one example of a top right front perspective view of a wearable blanket 100. In an exemplary embodiment, a wearable blanket 100 can comprise a back fabric panel 150 that can be trapezoid in shape and a front fabric panel 148 that can be trapezoid in shape and comprise a first seam 120 and a second seam 122. The front fabric panel 148 can be overlaid with the back fabric panel 150 and fastened together by stitching or otherwise along a perimeter 130 forming a first side edge 126, a second side edge 128, a top edge 124, and a bottom edge 134. The bottom edge 134 can be longer than the top edge 124 making it easier to wrap the legs of person 202 while enabling person 202 to stand, walk, and sit while wearing the wearable blanket 100.

While a preferred embodiment of the present invention utilizes a front fabric panel 148 and a back fabric panel 150 that is trapezoid in shape, in a plurality of other exemplary embodiments, variations of the trapezoid shape fabric panels can be implemented, as may be required and/or desired in a particular embodiment.

In addition, such front fabric panel 148, back fabric panel 150, flap pocket, hook-and-loop cover 114, and pocket bags 110/112 can be cotton fiber, polyester fiber, down, fleece, wool, vellux, water/wind resistant, a combination thereof, or other types and kinds of materials, as may be required and/or desired in a particular embodiment. The flap pocket 106 can be formed with one or more layers of material that are fastened around the perimeter 140 by sewing, adhesive, or otherwise. The hook-and-loop cover 114 can be formed with one or more layers of material that are fastened around the perimeter 138 by sewing, adhesive, or otherwise.

In an exemplary embodiment, the wearable blanket 100 further comprises one or more of a pocket bag 110/112. Each of the pocket bags 110/112 has an open end 156/158 and a closed end 152/154. The pocket bag 110/112 is positioned between the back fabric layer 150 and the front fabric layer 148. The open end 156 of the first one of the pocket bag 112 is aligned with the first seam 120 and the closed end 152 points to the first side 126 and can be tacked or otherwise fastened into position. The open end 158 of the second one of the pocket bag 110 is aligned with the second seam 122 and the closed end 154 points to the second side 128 and can be tacked or otherwise fastened into position. The pockets 102/104 formed by the pocket bags 110/112 allow a person 202 to insert their hands into the pocket bags 110/112 when wearing the wearable blanket 100.

In an exemplary embodiment, the pockets 102/104 can be opened and fastened closed. Such fasteners can be buttons, buckles, zippers, hook-and-loop, and other fasteners, as may be required and/or desired in a particular embodiment.

Figure 12:
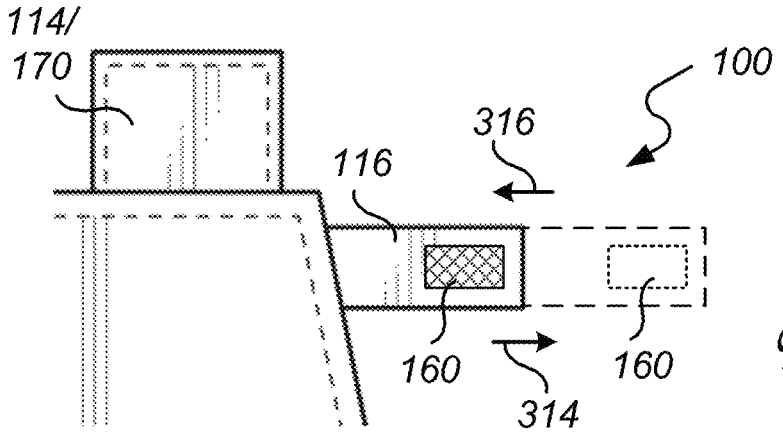
FIG. 12 illustrates one example of a stretchable belt tab.

In an exemplary embodiment, and with reference to at least FIG. 12, the wearable blanket 100 can comprise a stretchable belt tab 116 that can be positioned and secured along the second edge 128 proximate to the top edge 124. The stretchable belt tab 116 is stretchable 314 and can have a hook-and-loop surface 160 fastened onto it, such as by sewing, adhesive, or otherwise to at least a portion of the stretchable belt tab 116. A belt receiver 118 can be fastened by sewing, adhesive, or otherwise to the front fabric panel 148 proximate to the top edge 124, at least a portion of the belt receiver 118 has a hook-and-loop surface 162 for fastening with the stretchable belt tab 116, in a stretched or elongated orientation 314 and in a removable manner, securing the wearable blanket 100 around the waist of the person 202 such that recoil force 316 of the stretchable belt tab 116 pulls the top edge 124 snuggly around the waist of the person 202 preventing the wearable blanket 100 from slipping or rotating when worn by the person 202.

For disclosure purposes, the term "in a removable manner" is intended to mean that the fastening, such as fastening the loose end of the stretchable belt tab 116 to the belt receiver 118, is temporary and can be removed as desired by person 202. This allows person 202 to readjust the fitment of the wearable blanket 100 easily. Additionally, in applications where the stretchable belt tab 116 is not needed, it can be secured, in a temporary manner, to the hook-and-loop cover 114. As such, while hook-and-loop is a type of fastener that lends itself well to fastening in a removable manner, the stretchable belt tab 116 can be secured with other fasteners such as buttons, buckles, zippers, and other fasteners can be configured and used in the present invention to provide temporary fastening, in a removable manner, as may be required and/or desired in a particular embodiment.

In an exemplary embodiment, the stretchable belt tab 116 can be fabricated from elastic, rubber fabric, plastic leather, polymer, hook-and-loop material, other materials, or a combination thereof, as may be required and/or desired in a particular embodiment. The belt receiver 118 can be fabricated from fabric, leather, hook-and-loop material, other materials, or a combination thereof, as may be required and/or desired in a particular embodiment.

Figure 4:
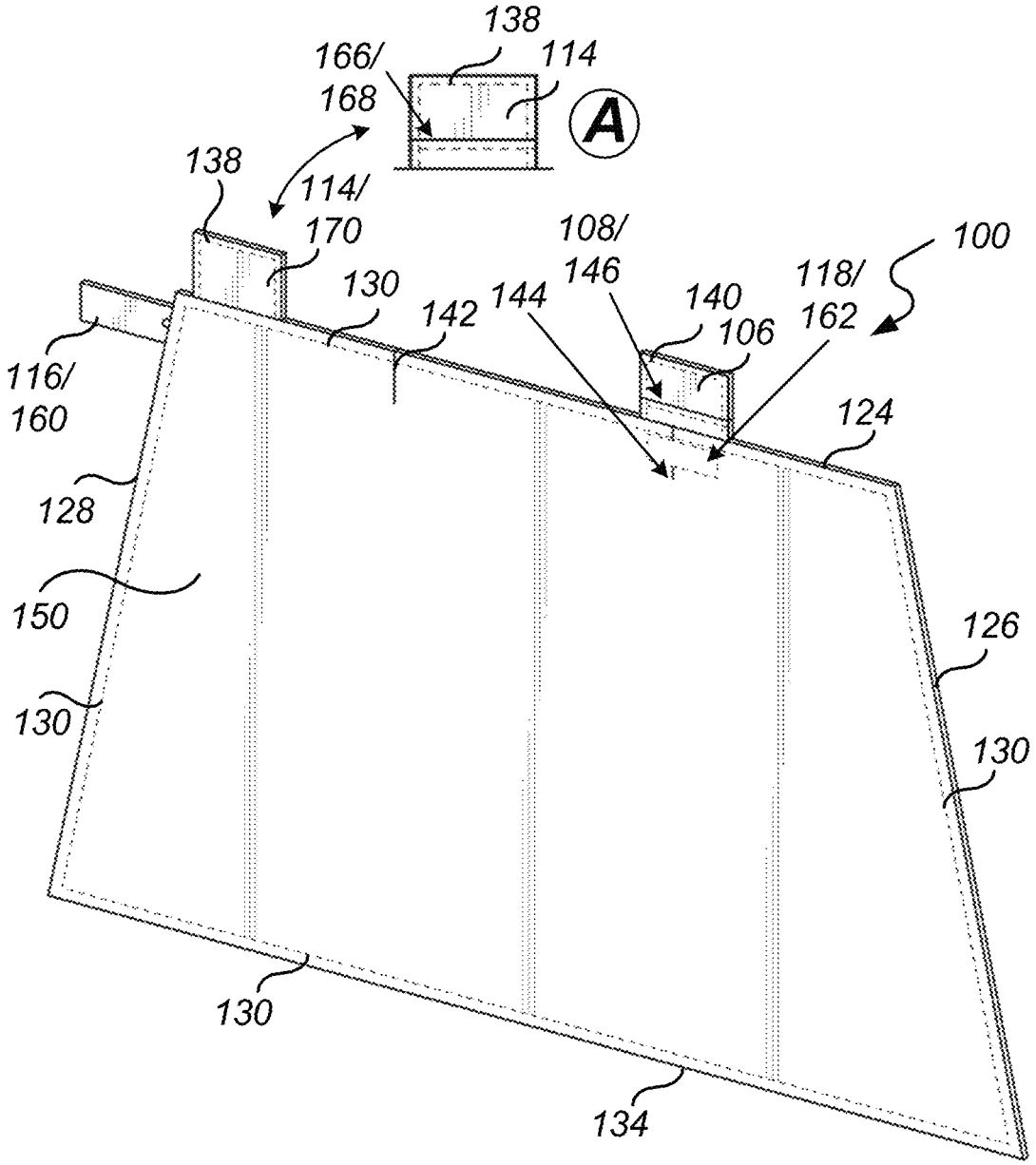
FIG. 4 illustrates one example of a top left back perspective view of a wearable blanket.
Figure 5:
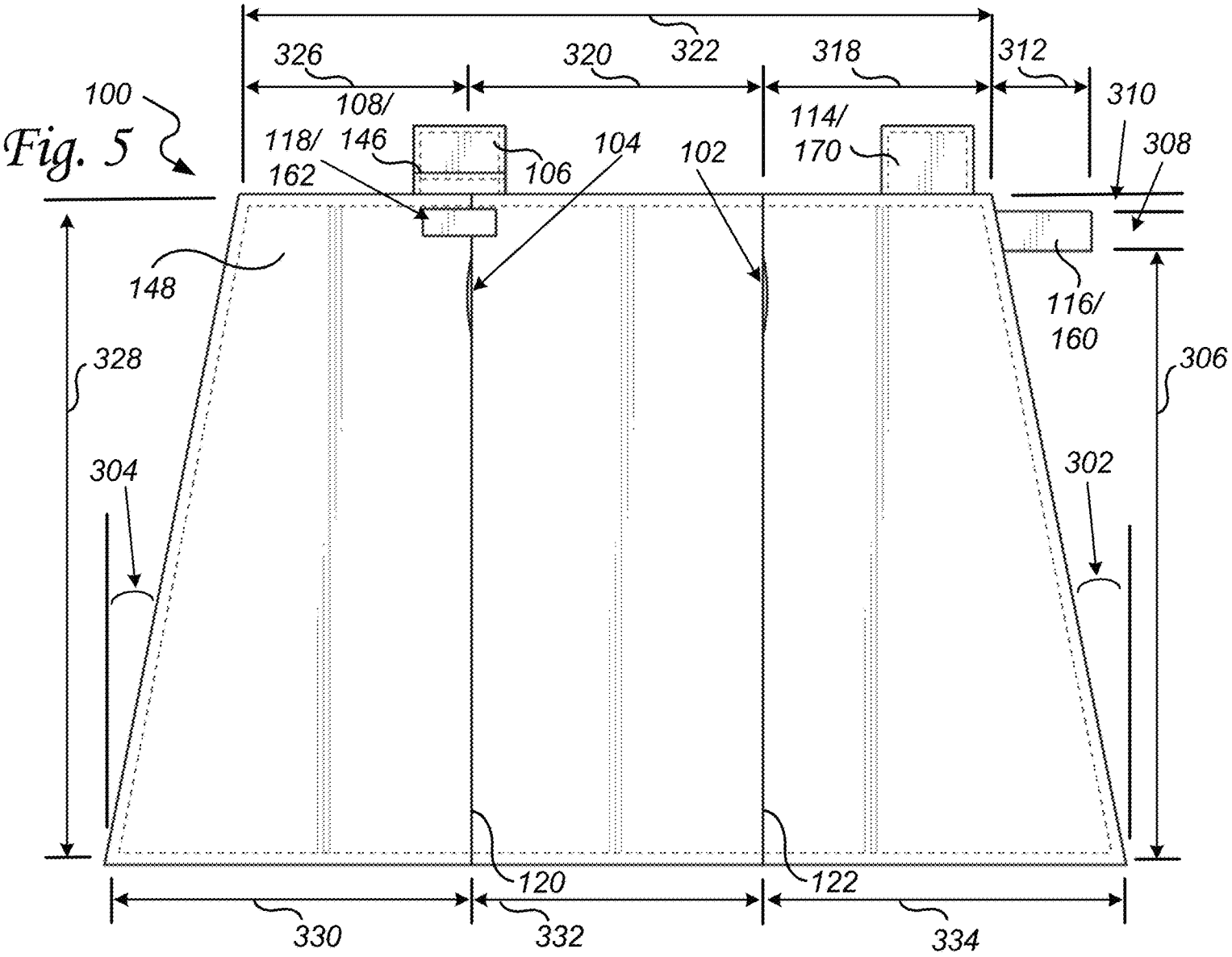
FIG. 5 illustrates one example of a front side view of a wearable blanket.

Referring to FIG. 4, there is illustrated one example of a top left back perspective view of a wearable blanket 100. In an exemplary embodiment, a hook-and-loop cover 114 can be positioned and secured along the top edge 124 proximate to the stretchable belt tab 116. The hook-and-loop cover 114 folds down to secure and cover the stretchable belt tab 116 when the wearable blanket 100 doesn't need to be secured around person 202. In this regard, when the wearable blanket 100 is used in a manner in which the stretchable belt tab 116 doesn't need to be secured to the belt receiver 118, the stretchable belt tab can be covered and secured by the hook-and-loop cover 114 so that hook-and-loop surface 160 doesn't inadvertently stick to the wearable blanket 100 by being left loose and uncovered. Such securing can be done by the hook-and-loop cover 114 having at least a portion covered by an opposing type of hook-and-loop material so that the stretchable belt tab 116 fastens, in a removable manner, to the hook-and-loop cover 114. In this regard, the hook-and-loop cover 114 can further comprise an opposing hook-and-loop surface 170 to the hook-and-loop surface associated with the stretchable belt tab 116 so that the loose end of the stretchable belt tab 116 fastens, in a removable manner, to the opposing hook-and-loop surface 170 when not in use.

In an exemplary embodiment, a flap pocket 106 comprises a flap pocket opening 108 having a pocket fastener 146. The flap pocket 106 is positioned to fold down to cover the belt receiver 118. The flap pocket 106 is secured along the top edge 124 and by way of the pocket opening 108 is accessible to person 202 for storing items. In operation, when person 202 wraps the wearable blanket 100 around themselves and snuggly secures the stretchable belt tab 116 which has a hook-and-loop surface 160 to the belt receiver 118 which has an opposing hook-and-loop surface 162, the flap pocket 106 can then be folded down to cover the joined stretchable belt tab 116 and belt receiver 118 to prevent inadvertent bumping and to present a more fashionable and polished look of the wearable blanket 100 when worn by person 202 by hiding the union of the stretchable belt tab 116 and belt receiver 118.

An advantage, in the present invention, is that when the wearable blanket 100 is being used as a blanket, towel, or for other purposes that don't require the stretchable belt tab 116 to be fastened to the belt receiver 118, the flap pocket 106 folds down and covers the belt receiver 118. In this regard, by the flap pocket 106 folding down and covering the otherwise exposed belt receiver 118, the belt receiver 118 is prevented from inadvertently snagging on other surfaces or becoming a scratch concern on the skin of the person 202 using the wearable blanket 100.

While in a preferred embodiment the hook-and-loop surfaces 160/162 can be used to secure the wearable blanket 100 around the person 202, other fasteners can also be used instead of or in combination with the hook-and-loop surfaces 160/162. In this regard, other fasteners can be buttons, snaps, belts/buckles, or other types and kinds of fasteners as may be required or desired in a particular embodiment.

In a preferred embodiment, the flap pocket fastener 146 can be buttons, hook-and-loop, a zipper, or other types or kinds of fasteners as may be required and/or desired in a particular embodiment.

Figure 11:
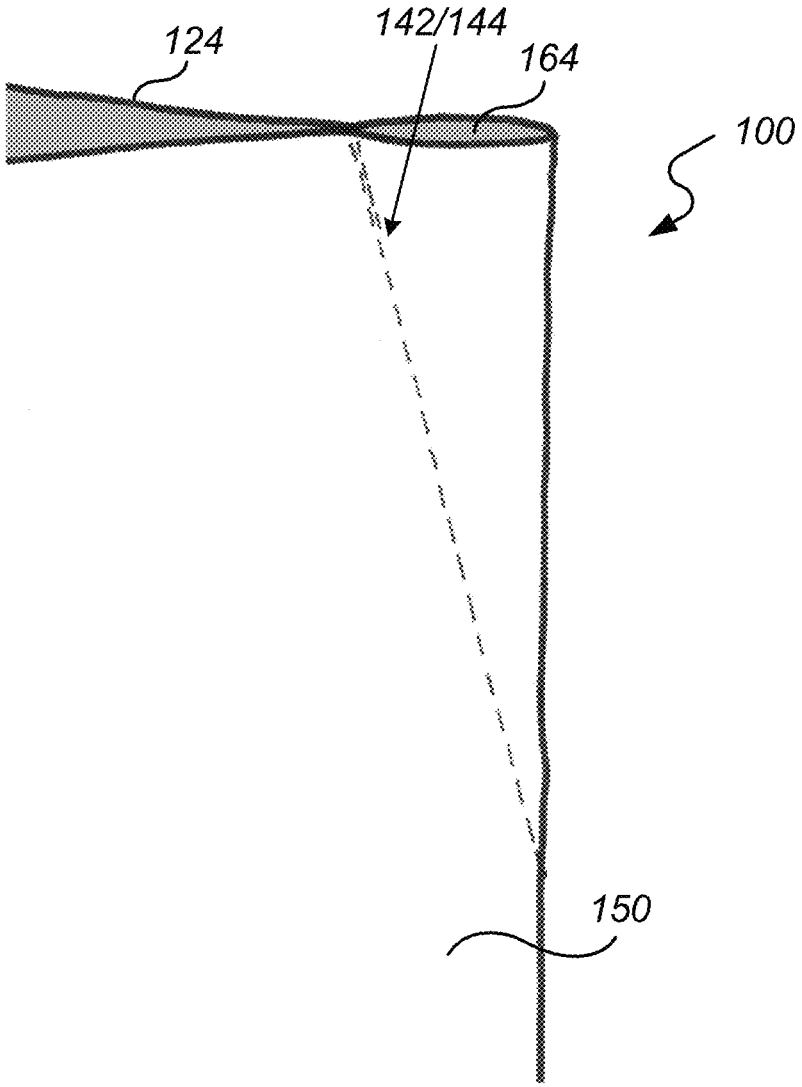
FIG. 11 illustrates one example of a hip dart.

In an exemplary embodiment, one or more hip dart 142/144 can be positioned proximate to the top edge 124 to improve fit around the waist or torso of the person 202. At least FIG. 11 illustrates one example of a hip dart 142/144. In operation, the hip dart 142/144 can be created by pulling two edges of the front fabric panel 148 and/or back fabric panel 150 together along the top edge 124 and sewing, adhering, or otherwise fastening to create a small pocket of material 164 that allows the top edge 124 to better fit the contours of the waist or torso of the person 202.

In FIG. 4 reference 'A' there is illustrated a hook-and-loop cover 114 pocket option. In this regard, a hook-and-loop cover 114 can be formed with at least two fabric layers creating a hook-and-loop cover pocket 166 therebetween. The hook-and-loop cover 114 has a hook-and-loop pocket 168 opening that person 202 can open to access the hook-and-loop cover pocket 166 and fasten closed securing items inside the hook-and-loop cover pocket 166. The hook-and-loop cover pocket 166 can be opened and fastened closed by way of hook-and-loop, buttons, zipper, or other types and kinds of fasteners as may be required and/or desired in a particular embodiment.

Figure 6:
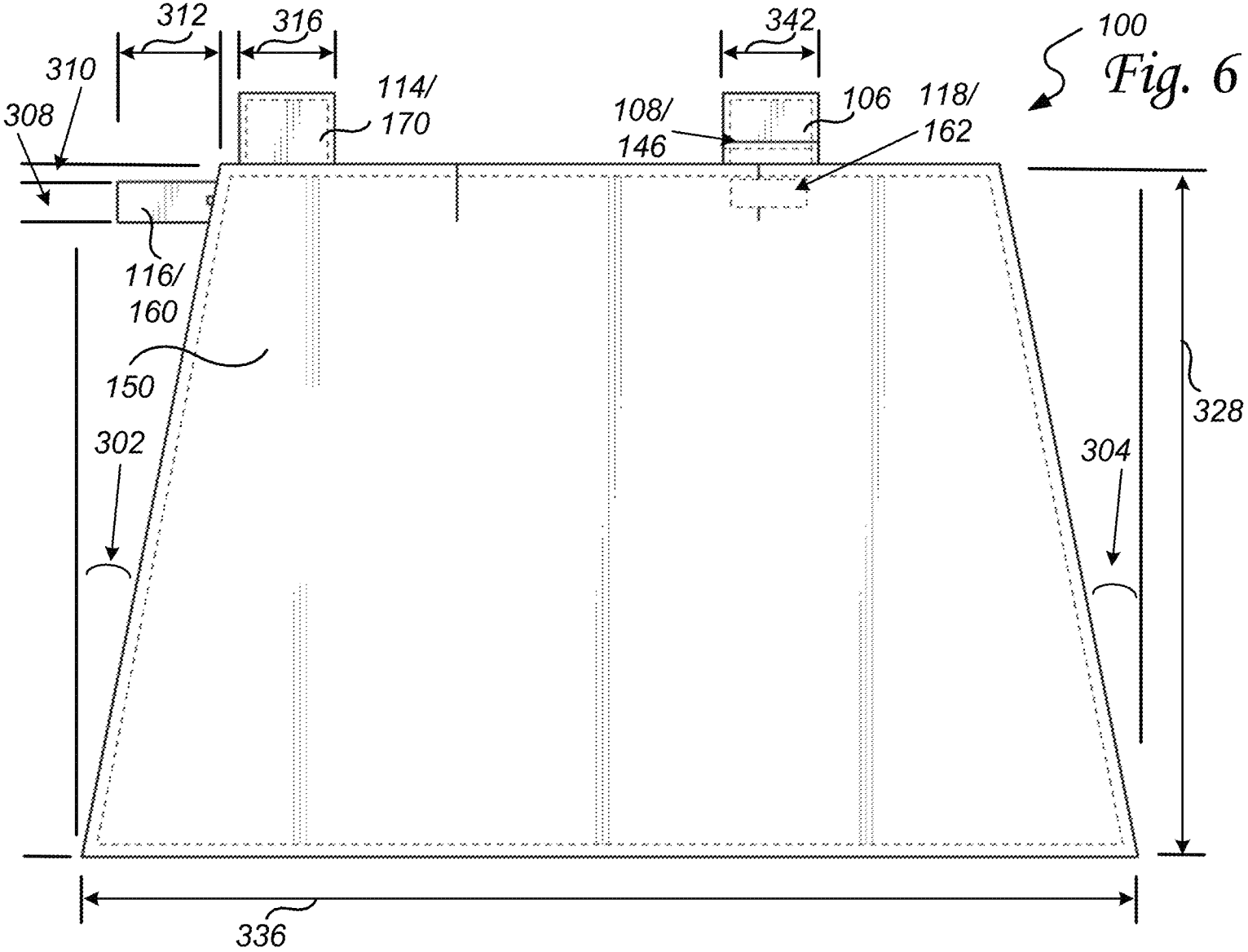
FIG. 6 illustrates one example of a backside view of a wearable blanket.
Figure 9:
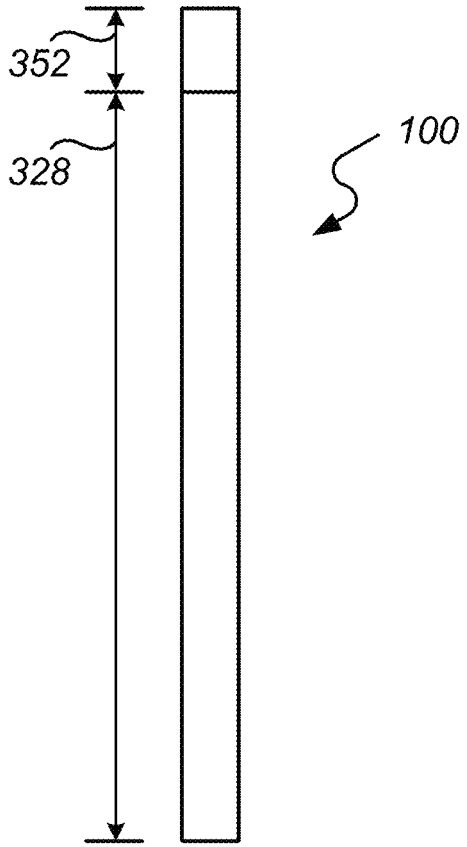
FIG. 9 illustrates one example of a left side view of a wearable blanket.
Figure 10:
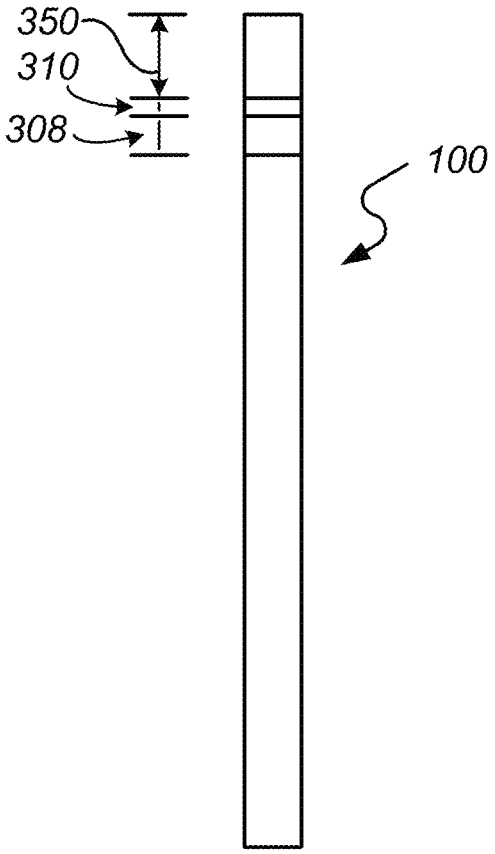
FIG. 10 illustrates one example of a right side view of a wearable blanket.

Referring to FIGS. 5-10, FIG. 5 illustrates one example of a front side view of a wearable blanket 100. FIG. 6 illustrates one example of a backside view of a wearable blanket 100. FIG. 7 illustrates one example of a top side view of a wearable blanket 100. FIG. 8 illustrates one example of a bottom side view of a wearable blanket 100. FIG. 9 illustrates one example of a left side view of a wearable blanket 100. FIG. 10 illustrates one example of a right side view of a wearable blanket 100.

The wearable blanket 100 of the present invention can be manufactured in a plurality of different sizes while maintaining the basic shape and proportions to accommodate small, medium, and larger persons 202. In an exemplary embodiment, the length 322 of the top edge 124 can be in the range of 40 inches to 49.5 inches. The length 336 of the bottom edge 134 can be in the range of 50 inches to 60 inches. The perpendicular length 328 between the top edge 124 and the bottom edge 134 can be in the range of 30 inches to 40 inches. In a plurality of other exemplary embodiments, other ranges of sizes can be implemented as may be required and/or desired in a particular embodiment.

Figure 13:
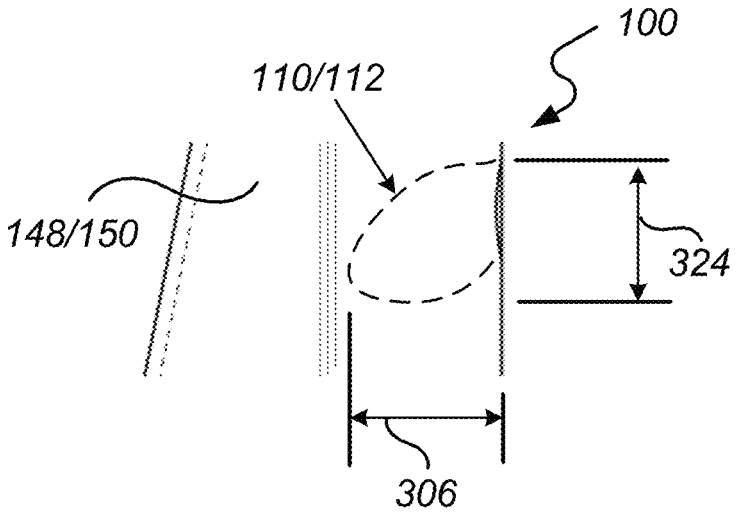
FIG. 13 illustrates one example of a pocket bag.

In an exemplary embodiment and with reference to FIG. 13, the pocket bag 110/112 width 324 can be in the range of 4 inches to 7 inches, and the pocket bag 110/112 length 306 can be in the range of 9 inches to 11 inches.

In an exemplary embodiment, the length of the hip darts 142/144 can be in the range of 2 inches to 4 inches. The width of flap pocket 342 can be in the range of 4.25 inches to 6.25 inches, and the length 352 of flap pocket 106 can be in the range of 3.25 inches to 5.25 inches. The width 346 of the hook-and-loop cover 114 can be in the range of 4 inches to 6 inches and the length 350 of the hook-and-loop cover can be in the range of 3.75 inches to 5.75 inches.

In an exemplary embodiment, the width of the top edge 124 side panels 318/326 can be in the range of 11 inches to 14 inches, and the width of the top edge 124 center panel 320 can be in the range of 15 inches to 17 inches. The width of the bottom edge 134 side panels 330/334 can be in the range of 15 inches to 18 inches, and the width of the bottom edge 134 center panel 332 can be in the range of 20 inches to 23 inches. The bottom edge 134 is longer than the top edge 124 forming angles 302/304 which creates the trapezoid shape of the wearable blanket 100.

Figure 14:
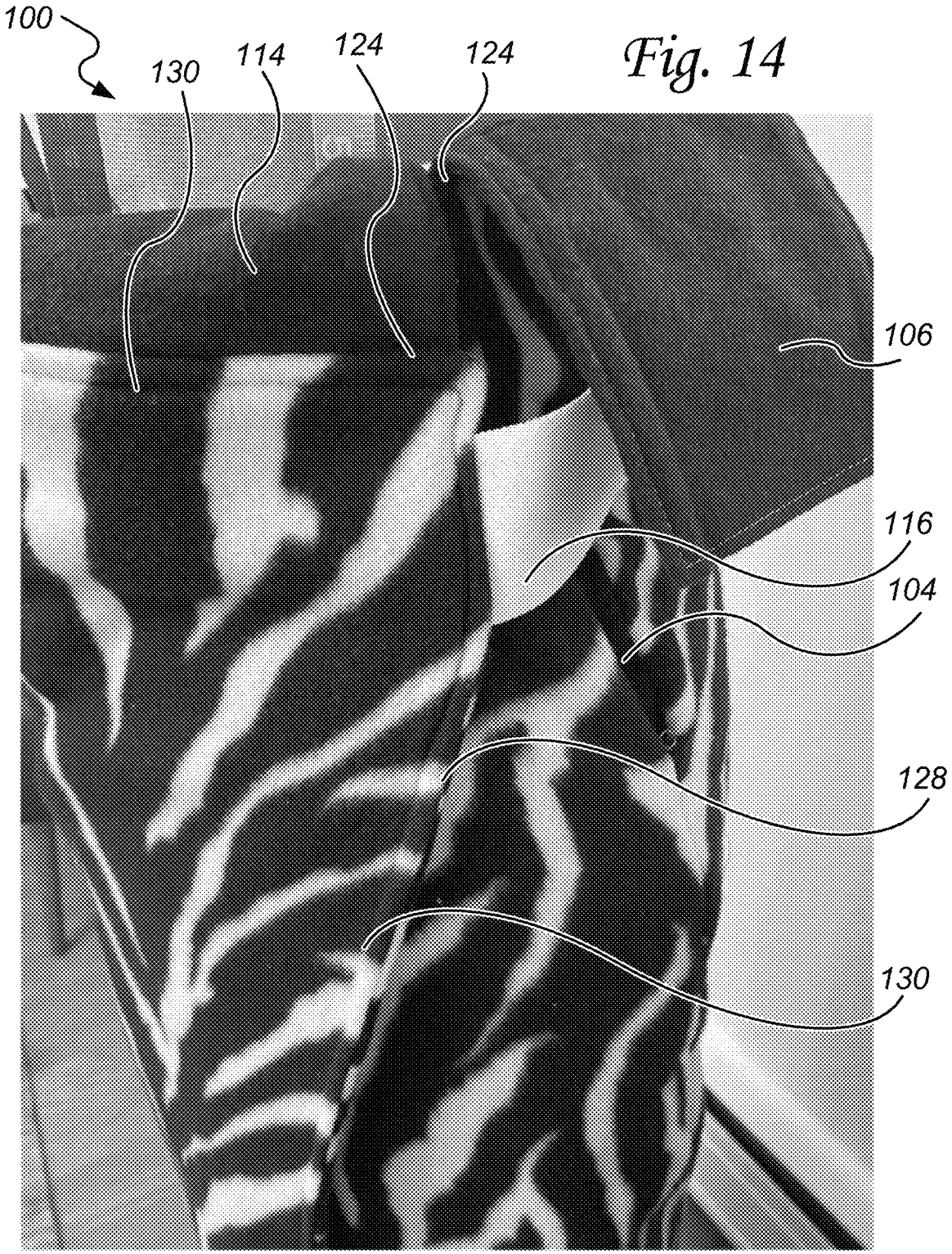
FIG. 14 illustrates one example of a wearable blanket layered top edge with stretchable belt tab fastening.

Referring to FIG. 14, there is illustrated one example of a wearable blanket 100 layered top edge 124 with stretchable belt tab 116 fastening. In an exemplary embodiment, the width 312 of the stretchable belt tab 116 can be in the range of 4 inches to 6 inches, and the length 308 of the stretchable belt tab 116 can be in the range of 1 inch to 3 inches. The stretchable belt tab 116 can be positioned and affixed on the second side 128 in the range 310 of 1 inch to 2 inches below the top edge 124.

An advantage, in the present invention, of the stretchable belt tab 116 being positioned along the second side 128 below the top edge 124 rather than co-aligned with the top edge 124 is that when the wearable blanket 100 is wrapped around person 202 much of the bulk material around the waist that would be created if the top edges 124 were to overlap if co-aligned is eliminated. In this regard, because of the positioning of the stretchable belt tab 116 the top edges 124 can be positioned so as to not co-align and overlap where they cross in the front of the waist of person 202 instead of layering next to each other which prevents bulking of the material at the belt line of person 202. This makes wearing the wearable blanket 100 more comfortable and allows person 202 to more easily bend and move at the waist. As illustrated in FIG. 14, the stretchable belt tab 116 can ascend from the connection at the second side 128 upward slightly to mate with the belt receiver 118 which is affixed to the front fabric surface 148 proximate closer to the top edge 124 at the perimeter 130.

Figure 15:
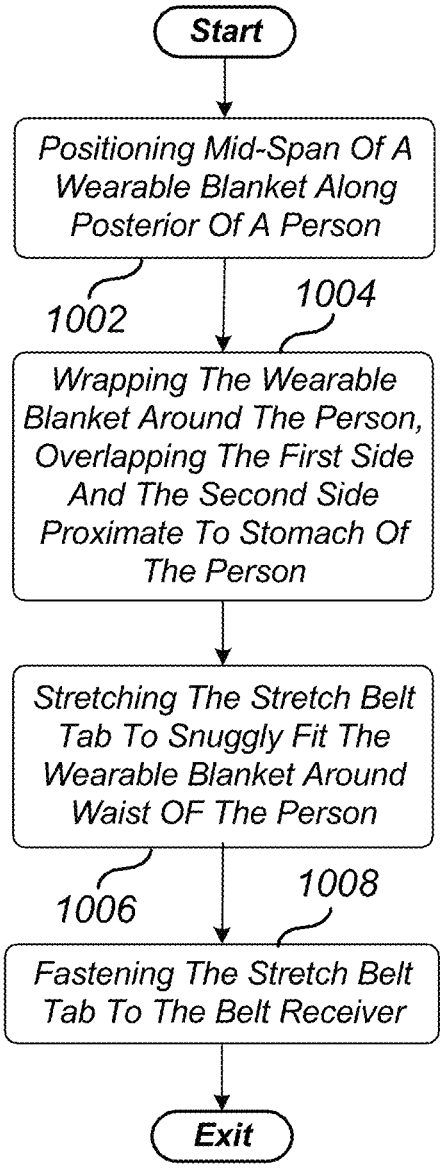
FIGS. 15 and 16 illustrate examples of a method of using a wearable blanket.

Referring to FIG. 15, there is illustrated one example of a method of using a wearable blanket 100. In an exemplary embodiment, the wearable blanket 100 can be secured around the waist or torso of a person 202. The method begins in step 1002.

In step 1002, a wearable blanket 100 can be positioned along the posterior of a person. The wearable blanket 100 can comprise a back fabric panel 150 that is trapezoid in shape and a front fabric panel 148 that is trapezoid in shade. The front fabric panel 148 comprises a first seam 122 and a second seam 124. The front fabric panel 148 is overlaid with the back fabric panel 150 and fastened together along a perimeter 130 forming a first side edge 126, a second side edge 128, a top edge 124, and a bottom edge 134 that is longer than the top edge 124.

The wearable blanket further comprises one or more pocket bags 110/112. Each of the pocket bags 110/112 has an open end 156/158 and a closed end 152/154. The pocket bags 110/112 are positioned between the back fabric layer 150 and the front fabric layer 148. The open end 156 of the first one of the pocket bag 112 is aligned with the first seam 120 and the closed end 152 points to the first side 126 and can be tacked or otherwise fastened into position. The open end 158 of the second one of the pocket bag 110 is aligned with the second seam 122 and the closed end 154 points to the second side 128 and can be tacked or otherwise fastened into position. The pockets 102/104 formed by the pocket bags 110/112 allow person 202 to insert their hands into the pocket bags 110/112 when wearing the wearable blanket 100.

With reference to FIG. 12, the wearable blanket 100 further comprises a stretchable belt tab 116 that can be positioned and secured along the second edge 128 proximate to the top edge 124. The stretchable belt tab 116 is stretchable 314. A hook-and-loop surface 160 can be fastened to at least a portion of the stretchable belt tab 116. A belt receiver 118 can be fastened to the front fabric panel 148 proximate to the top edge 124. At least a portion of the belt receiver 118 can have a hook-and-loop surface 162 for fastening with the stretchable belt tab 116 in a stretched or elongated orientation 314 securing the wearable blanket 100 around the waist of the person such that the recoil force 316 of the stretchable belt tab 116 pulls the top edge 124 snuggly around the waist of the person 202 preventing the wearable blanket 100 from slipping or rotating when worn by the person 202.

In operation, the stretchable belt tab 116 is positioned attached to the second side 116 and the belt receiver 118 is fastened to the front fabric panel 148 in a manner in which they are aligned. In this regard, when the wearable blanket 100 is wrapped around the waist or torso of person 202 the stretchable belt tab 116 and the belt receiver 118 overlaps making it easy to fasten together securing the wearable blanket 100 around person 202. The method then moves to step 1004.

In step 1004, The wearable blanket 100 is wrapped around person 2020, overlapping the first side 126 and the second side 128 proximate to the stomach of the person. The method then moves to step 1006.

In step 1006, the stretchable belt tab 116 is stretched to snuggly fit the wearable blanket 100 around the waist of person 202. The method then moves to step 1008.

In step 1008, the stretchable belt tab 116 is fastened to the belt receiver 118, in a removable manner, holding the wearable blanket 100 in place around person 202. The method is then exited.

Figure 16:
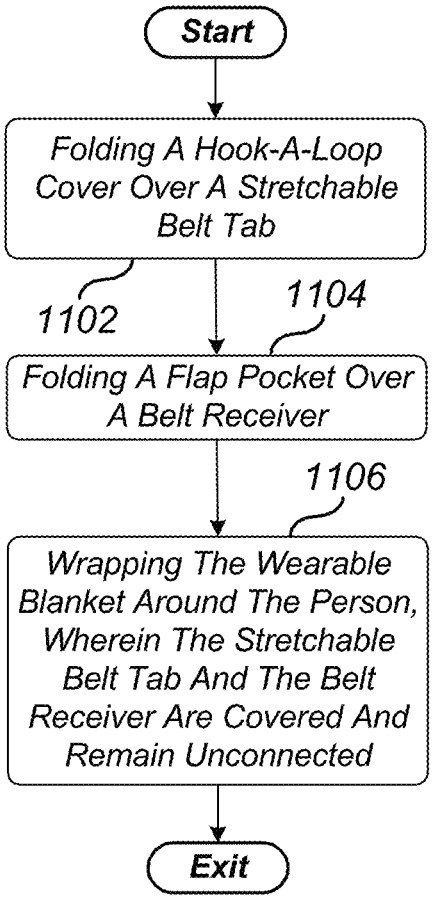

Referring to FIG. 16, there is illustrated one example of a method of using a wearable blanket 100. In an exemplary embodiment, the wearable blanket 100 can be used without securing it around person 202 with the stretchable belt tab 116 and belt receiver 118. In this regard, the loose end of the stretchable belt tab 116 can be covered and secured with a hook-and-loop cover 114. Additionally, the belt receiver 118 can also be covered by the flap pocket 106. Covering and securing the stretchable belt tab 116 and the belt receiver 118 prevents the hook-and-loop surfaces 160/162 from inadvertently sticking to other portions of the wearable blanket 100, the person's 202 clothing, or other surfaces. In addition, by covering and securing the hook-and-loop surfaces 160/162 it prevents what can be scratchy surface from rubbing against other surfaces as well as the person's 202 skin. The method begins in step 1102.

In step 1102, a hook-and-loop cover 114 is folded over a stretchable belt tab 116, to secure the loose end of the stretchable belt tab in a removable manner, when the wearable blanket 100 doesn't need to be secured around a person 202. The hook-and-loop cover 114 is positioned and secured along a top edge 124 proximate to the stretchable belt tab 116. Such securing can be done by the hook-and-loop cover 114 having at least a portion covered by an opposing type of hook-and-loop material so that the stretchable belt tab 116 fastens, in a removable manner, to the hook-and-loop cover 114. In this regard, the hook-and-loop cover 114 can further comprise an opposing hook-and-loop surface 170 to the hook-and-loop surface associated with the stretchable belt tab 116 so that the loose end of the stretchable belt tab 116 fastens, in a removable manner, to the opposing hook-and-loop surface 170 when not in use. The method then moves to step 1104.

In step 1104, a flap pocket 106 is folded over a belt receiver 118. The flap pocket 106 comprises a flap pocket opening 108 having a pocket fastener 146. The flap pocket 106 is positioned and secured along a top edge 124 proximate to the belt receiver 118. The flap pocket 106 by way of the pocket opening 108 is accessible to person 202 for storing items.

The wearable blanket 100 comprises the hook-and-loop cover 114, the flap pocket 106, a back fabric panel 150 that is trapezoid in shape, and a front fabric panel 148 that is trapezoid in shape. The front fabric panel 148 comprises a first seam 120 and a second seam 122. The front fabric panel 148 is overlaid with the back fabric panel 150 and fastened together along a perimeter 130 forming a first side edge 126, a second side edge 128, the top edge 124, and a bottom edge 134 that is longer than the top edge 124.

The wearable blanket further comprises one or more pocket bags 110/112. Each of the pocket bags 110/112 has an open end 156/158 and a closed end 152/154. The pocket bags 110/112 are positioned between the back fabric layer 150 and the front fabric layer 148. The open end 156 of the first one of the pocket bag 112 is aligned with the first seam 120 and the closed end 152 points to the first side 126 and can be tacked or otherwise fastened into position. The open end 158 of the second one of the pocket bag 110 is aligned with the second seam 122 and the closed end 154 points to the second side 128 and can be tacked or otherwise fastened into position. The pockets 102/104 formed by the pocket bags 110/112 allow person 202 to insert their hands into the pocket bags 110/112 when wearing the wearable blanket 100.

The wearable blanket 100 further comprises a stretchable belt tab 116 that can be positioned and secured along the second edge 128 proximate to the top edge 124. The stretchable belt tab 116 is stretchable. A hook-and-loop surface 160 can be fastened to at least a portion of the stretchable belt tab 116. A belt receiver 118 is fastened to the front fabric panel 150 proximate to the top edge 124. At least a portion of the belt receiver 118 has a hook-and-loop surface 162. The method then moves to step 1106.

In step 1106, the wearable blanket 100 is wrapped around person 202, wherein the stretchable belt tab 116 and the belt receiver 118 are covered and remain unconnected. The method is then exited.

Figure 17:
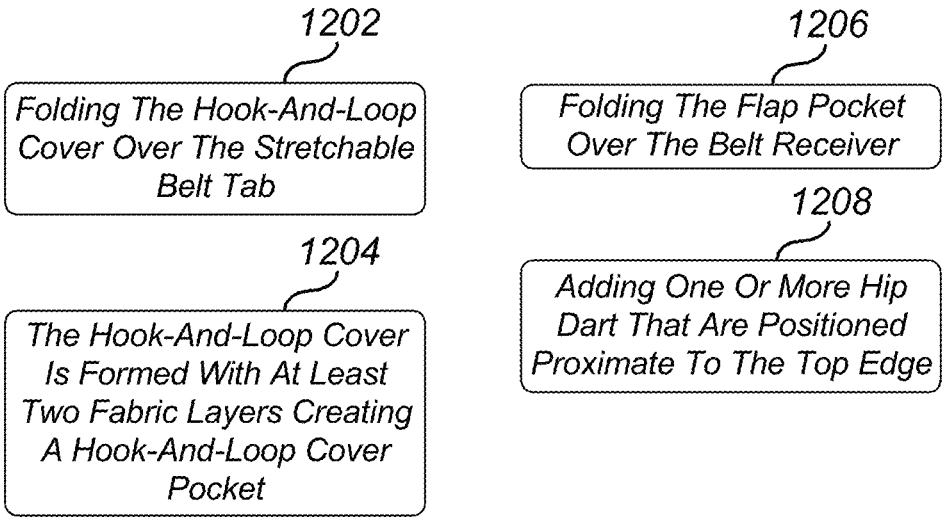
FIG. 17 illustrates exemplary embodiments that can be interchangeably used with the methods of the present invention.

Referring to FIG. 17, there are illustrated exemplary embodiments that can be interchangeably used with the methods of the present invention.

In step 1202, the hook-and-loop cover 114 is folded over the stretchable belt tab 116 securing the loose end of the stretchable belt tab 116, in a removable manner, when the wearable blanket 100 doesn't need to be secured around the person 202. The wearable blanket 100 comprises the hook-and-loop cover 114. The hook-and-loop cover 114 is positioned and secured along the top edge 124 proximate to the stretchable belt tab 116. Such securing can be done by the hook-and-loop cover 114 having at least a portion covered by an opposing type of hook-and-loop material so that the stretchable belt tab 116 fastens, in a removable manner, to the hook-and-loop cover 114.

In step 1204, in FIG. 4 reference 'A' there is illustrated a hook-and-loop cover 114 pocket option. In this regard, a hook-and-loop cover 114 can be formed with at least two fabric layers creating a hook-and-loop cover pocket 166 therebetween. The hook-and-loop cover 114 has a hook-and-loop pocket 168 opening that person 202 can open to access the hook-and-loop cover pocket 166 and fasten closed securing items inside the hook-and-loop cover pocket 166. The hook-and-loop cover pocket 166 can be opened and fastened closed by way of hook-and-loop, buttons, zipper, or other types and kinds of fasteners as may be required and/or desired in a particular embodiment.

In step 1206, the flap pocket 106 can be folded over the belt receiver 118. The wearable blanket 100 comprises the flap pocket 106. The flap pocket 106 comprises a flap pocket opening 108 having a pocket fastener 146. The flap pocket 106 is secured along the top edge 124 and by way of the pocket opening 108 the flap pocket 106 is accessible to person 202 for storing items.

In step 1208, one or more hip dart 142/144 can be added. The hip dart 142/144 can be positioned proximate to the top edge 124 to improve fit around the waist of the person 202.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A wearable blanket usable as a blanket, a towel, a wrap, and worn fashionably as a skirt, the wearable blanket comprising:

a back fabric panel that is trapezoid in shape;

a front fabric panel that is trapezoid in shape and comprises a first seam and a second seam, the front fabric panel is overlaid with the back fabric panel and fastened together along perimeter forming a first side edge, and a second side edge, a top edge, and a bottom edge that is longer than the top edge;

one or more of a pocket bag, each of the pocket bag having an open end and a closed end, the pocket bag is positioned between the back fabric layer and the front fabric layer, the open end of first one of the pocket bag is aligned with the first seam and the closed end points to the first side, the open end of second one of the pocket bag is aligned with the second seam and the closed end points to the second side, allowing a person to insert their hands into the pocket bag when wearing the wearable blanket;

a stretchable belt tab is positioned and secured along the second edge proximate to the top edge, the stretchable belt tab is stretchable, a first hook-and-loop surface is fastened to at least portion of the stretchable belt tab; and a belt receiver is fastened to the front fabric panel proximate to the top edge, at least portion of the belt receiver having a second hook-and-loop surface for fastening, in a removable manner, with the first hook-and-loop surface when the stretchable belt tab is in a stretched orientation, securing the wearable blanket around waist of the person such that recoil force of the stretchable belt tab pulls the top edge snuggly around waist of the person preventing the wearable blanket from slipping or rotating when worn by the person.

2. The wearable blanket in accordance with claim 1, further comprising:

a hook-and-loop cover is positioned and secured along the top edge proximate to the stretchable belt tab, the hook-and-loop cover folds down to secure and cover the stretchable belt tab when the wearable blanket doesn't need to be secured around the person.

3. The wearable blanket in accordance with claim 2, the hook-and-loop cover further comprises an opposing hook-and-loop surface to the first hook-and-loop surface so that loose end of the stretchable belt tab fastens, in removable manner, to the opposing hook-and-loop surface when not in use.

4. The wearable blanket in accordance with claim 2, the hook-and-loop cover is formed of at least two fabric layers creating a hook-and-loop cover pocket therebetween, the hook-and-loop cover having a hook-and-loop pocket opening that the person can open to access the hook-and-loop cover pocket and fasten closed securing items inside the hook-and-loop cover pocket.

5. The wearable blanket in accordance with claim 1, further comprising:

a flap pocket comprises a flap pocket opening having a pocket fastener, the flap pocket is positioned to fold down to cover the belt receiver, the flap pocket is secured along the top edge and by way of the pocket opening is accessible to the person for storing items.

6. The wearable blanket in accordance with claim 5, the flap pocket fastener is at least one of the following buttons, hook-and-loop, or a zipper.

7. The wearable blanket in accordance with claim 1, further comprising:

one or more hip dart is positioned proximate to the top edge.

8. The wearable blanket in accordance with claim 1, length of the top edge is in range of 40 inches to 49.5 inches, length of the bottom edge is in range of 50 inches to 60 inches, and perpendicular length between the top edge and the bottom edge is in range of 30 inches to 40 inches.

9. The wearable blanket in accordance with claim 1, the pocket bag width is in range of 4 inches to 7 inches, and the pocket bag length is in range of 9 inches to 11 inches, length of at least one of the hip dart is in range of 2 inches to 4 inches, width of the flap pocket is in range of 4.25 inches to 6.25 inches, length of flap pocket is in range of 3.25 inches to 5.25 inches, and width of the hook-and-loop cover is in range of 4 inches to 6 inches, length of the hook-and-loop cover is in range of 3.75 inches to 5.75 inches.

10. A method of using a wearable blanket that can be used as a blanket, a towel, a wrap, and worn fashionably as a skirt, the method comprising the steps of:

positioning a wearable blanket along posterior of a person, the wearable blanket comprising a back fabric panel that is trapezoid in shape, and a front fabric panel that is trapezoid in shade, the front fabric panel comprises a first seam and a second seam, the front fabric panel is overlaid with the back fabric panel and fastened together along perimeter forming a first side edge, and a second side edge, a top edge, and a bottom edge that is longer than the top edge, one or more of a pocket bag, each of the pocket bag having an open end and a closed end, the pocket bag is positioned between the back fabric layer and the front fabric layer, the open end of first one of the pocket bag is aligned with the first seam and the closed end points to the first side, the open end of second one of the pocket bag is aligned with the second seam and the closed end points to the second side, allowing the person to insert their hands into the pocket bag when wearing the wearable blanket, a stretchable belt tab is positioned and secured along the second edge proximate to the top edge, the stretchable belt tab is stretchable, a first hook-and-loop surface is fastened to at least portion of the stretchable belt tab, a belt receiver is fastened to the front fabric panel proximate to the top edge, at least portion of the belt receiver having a second hook-and-loop surface for fastening, in a removable manner, with the first hook-and-loop surface when the stretchable belt tab is in a stretched orientation securing the wearable blanket around waist of the person such that recoil force of the stretchable belt tab pulls the top edge snuggly around waist of the person preventing the wearable blanket from slipping or rotating when worn by the person;

wrapping the wearable blanket around the person, overlapping the first side and the second side proximate to stomach of the person;

stretching the stretchable belt tab to snuggly fit the wearable blanket around waist of the person; and fastening the stretchable belt tab to the belt receiver, in a removable manner, holding the wearable blanket around the person.

11. The method in accordance with claim 10, further comprising the step of:

folding the hook-and-loop cover over the stretchable belt tab securing loose end of the stretchable belt tab when the wearable blanket doesn't need to be secured around the person, the wearable blanket comprises the hook-and-loop cover, the hook-and-loop cover is positioned and secured along the top edge proximate to the stretchable belt tab.

12. The method in accordance with claim 11, the hook-and-loop cover is formed with at least two fabric layers creating a hook-and-loop cover pocket therebetween, the hook-and-loop cover having a hook-and-loop pocket opening that the person can open to access the hook-and-loop cover pocket and fasten closed securing items inside the hook-and-loop cover pocket.

13. The method in accordance with claim 10, further comprising the step of:

folding the flap pocket over the belt receiver, the wearable blanket comprises the flap pocket, the flap pocket comprises a flap pocket opening having a pocket fastener, the flap pocket is secured along the top edge and by way of the pocket opening the flap pocket is accessible to the person for storing items.

14. The method in accordance with claim 13, the flap pocket fastener is at least one of the following buttons, hook-and-loop, or a zipper.

15. The method in accordance with claim 10, further comprising the step of:

adding one or more hip dart that is positioned proximate to the top edge to improve fit around waist of the person.

16. The method in accordance with claim 10, the hook-and-loop cover further comprises an opposing hook-and-loop surface to the first hook-and-loop surface so that loose end of the stretchable belt tab fastens, in removable manner, to the opposing hook-and-loop surface when not in use.

17. A method of using a wearable blanket that can be used as a blanket, a towel, a wrap, and worn fashionably as a skirt, the method comprising the steps of:

folding a hook-and-loop cover over a stretchable belt tab, to secure loose end of the stretchable belt tab in a removable manner, when the wearable blanket doesn't need to be secured around a person, the hook-and-loop cover is positioned and secured along a top edge proximate to the stretchable belt tab;

folding a flap pocket over a belt receiver, the flap pocket comprises a flap pocket opening having a pocket fastener, the flap pocket is positioned and secured along a top edge proximate to the belt receiver, the flap pocket by way of the pocket opening is accessible to the person for storing items, the wearable blanket comprises the hook-and-loop cover, the flap pocket, a back fabric panel that is trapezoid in shape, and a front fabric panel that is trapezoid in shape, the front fabric panel comprises a first seam and a second seam, the front fabric panel is overlaid with the back fabric panel and fastened together along perimeter forming a first side edge, and a second side edge, the top edge, and a bottom edge that is longer than the top edge, one or more of a pocket bag, each of the pocket bag having an open end and a closed end, the pocket bag is positioned between the back fabric layer and the front fabric layer, the open end of first one of the pocket bag is aligned with the first seam and the closed end points to the first side, the open end of second one of the pocket bag is aligned with the second seam and the closed end points to the second side, allowing the person to insert their hands into the pocket bag when wearing the wearable blanket, a stretchable belt tab is positioned and secured along the second edge proximate to the top edge, the stretchable belt tab is stretchable, a first hook-and-loop surface is fastened to at least portion of the stretchable belt tab, a belt receiver is fastened to the front fabric panel proximate to the top edge, at least portion of the belt receiver having a second hook-and-loop surface; and wrapping the wearable blanket around the person wherein the stretchable belt tab and the belt receiver is covered and remains unconnected.

18. The method in accordance with claim 17, the flap pocket fastener is at least one of the following buttons, hook-and-loop, or a zipper.

19. The method in accordance with claim 17, further comprising the step of:

adding one or more hip dart that are positioned proximate to the top edge to improve fit around waist of the person.

20. The method in accordance with claim 17, the hook-and-loop cover further comprises an opposing hook-and-loop surface to the first hook-and-loop surface so that loose end of the stretchable belt tab fastens, in removable manner, to the opposing hook-and-loop surface when not in use.

* * * * *